US007762794B2

(12) United States Patent
Harada et al.

(10) Patent No.: US 7,762,794 B2
(45) Date of Patent: Jul. 27, 2010

(54) TUBE AND TUBE PUMP

(75) Inventors: Shuhei Harada, Nagano-ken (JP); Tetsuya Takamoto, Nagano-ken (JP); Takeshi Mori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 255 days.

(21) Appl. No.: 11/700,025

(22) Filed: Jan. 31, 2007

(65) Prior Publication Data

US 2007/0177992 A1 Aug. 2, 2007

(30) Foreign Application Priority Data

Feb. 1, 2006 (JP) ..... 2006-024158
Dec. 25, 2006 (JP) ..... 2006-347559

(51) Int. Cl.
*F04B 43/08* (2006.01)
*F04B 43/12* (2006.01)
*F04B 45/08* (2006.01)
*F04B 45/06* (2006.01)

(52) U.S. Cl. ..... 417/477.12

(58) Field of Classification Search ..... 417/477.12, 417/476, 477.13; 347/65, 85
See application file for complete search history.

(56) References Cited

U.S. PATENT DOCUMENTS 2,414,355 A * 1/1947 Bogoslowsky ..... 418/45
2,928,353 A * 3/1960 Murray ..... 417/475
4,102,612 A * 7/1978 Ritter ..... 417/477.12
4,131,399 A 12/1978 Calvet
4,767,289 A * 8/1988 Parrott et al. ..... 417/477.12
5,067,879 A 11/1991 Carpenter
5,561,453 A 10/1996 Shibata et al.
6,494,693 B1 * 12/2002 Sunden ..... 417/477.7
2002/0001530 A1 * 1/2002 Doi et al. ..... 417/477.12
2003/0138335 A1 * 7/2003 Doi et al. ..... 417/477.12

FOREIGN PATENT DOCUMENTS

JP 03111684 A * 5/1991
JP 2004-34525 A 2/2004

* cited by examiner

*Primary Examiner*—Devon C Kramer
*Assistant Examiner*—Bryan Lettman
(74) *Attorney, Agent, or Firm*—Sughrue Mion, PLLC

(57) ABSTRACT

The tube 110 has a hollow portion 111 and a wall portion 112. The tube 110 has mutually contacting wall portions 111*a* that become compressed in such a way that the wall portion 112 comes into mutual contact in the hollow portion 111 through compression by a compressing mechanism 120, and is designed so that the mutually contacting wall portions 111*a* come into mutual contact, and the mutually contacting wall portions 111*a* recover upon release of the compressing mechanism. The mutually contacting wall portions 111*a* have readily contacting portions C1 that come into mutual contact at a certain level of compressing force, and contact resistant portions S1 that come into mutual contact only at a higher level of compressing force than in the readily contacting portions C1. The thickness of the wall portion 12 around the hollow portion 11 varies so that the readily contacting portions C1 are subjected to greater force than the contact resistant portions S1.

2 Claims, 8 Drawing Sheets

112a
112b
112c
112d
112e
112f
111a
S1
X
Y
SEPARATION PORTION 112e
FORCE RECEIVING PORTION 112f

TUBE AND TUBE PUMP

CROSS REFERENCE TO RELATED APPLICATIONS

The present application claims the priority based on Japanese Patent Applications No. 2006-24158 filed on Feb. 1, 2006, and No. 2006-347559 filed on Dec. 25, 2006, the disclosures of which are hereby incorporated by reference in their entireties.

BACKGROUND OF THE INVENTION

1. Field of the Invention

The present invention relates to a tube pump for pumping fluids.

2. Description of the Related Art

Ink-jet type recording devices to date have employed ink-jet recording heads for ejecting ink onto recording paper or other media. An ink-jet recording head of this design ejects ink through nozzles onto recording paper or other medium, and thus there is a risk that ink might not be ejected smoothly if the ink in proximity to the nozzles should become viscous, or if air bubbles should become entrained in the nozzles. For this reason, ink-jet type recording devices are equipped with a head cleaning unit in order to avoid such phenomena.

The head cleaning unit has a capping mechanism including a cap to cover the nozzles, and a pump for creating negative pressure inside the cap; it is designed to effect cleaning by suctioning ink in proximity to the nozzles, by means of a pump. Tube pumps, which have relatively simple structure and are easily made compact, are used as pumps for this purpose (see JP2004-34525A (FIG. 3 etc.), for example). As illustrated in FIG. 7 of JP2004-34525A, the tube pump is designed to suction ink by means of compressing a tube with a roller while moving the roller in the clockwise direction, for example. Specifically, the roller moves while compressing the tube, and each portion of the tube over which the roller has passed recovers from the compressed state to its original state. This recovery of each tube portion generates negative pressure within the tube, and the ink is transported smoothly through the tube by means of this negative pressure. In preferred practice, the negative pressure created inside the tube will be as high a level as possible, and for this purpose it is preferable for the tube to be substantially completely compressible.

FIG. 9A shows a conventional tube 75, prior to being compressed, and FIG. 9B shows its compressed state. As shown in FIG. 9A, when the tube 75 of wall thickness t=1 mm is compressed by the roller 780 in the direction of the arrows in the drawing, the tube 75 collapses to thickness equivalent to 2t, as shown in FIG. 9B. However there was the problem that, as shown in FIG. 9B, in this state, the tube 75 does not sufficiently collapse so that some gaps S remain within the tube and an adequate negative pressure cannot be created during subsequent recovery. Thus, in the past, it was necessary to compress the tube 75 to an even further extent beyond the state depicted in FIG. 9B, in order to further reduce the gaps S shown in FIG. 9B. For example, it was necessary to compress the tube 75 of FIG. 9B by an additional extent of approximately 0.6 mm. Since excessive compression of the tube 75 in this way creates strong reaction force, a correspondingly high level of torque is required of the tube pump motor, which created the problem of lower efficiency of the tube pump.

SUMMARY OF THE INVENTION

An object of the present invention is to provide technology whereby an adequate level of fluid pumping force can be created, without the need for an excessively high level of compressing force.

According to one aspect of the present invention, there is provided a tube for use in a tube pump for pumping a fluid through compression of the tube by a compressing mechanism in association with movement of the compressing mechanism along the tube. The tube comprises a wall portion of elastic material, the wall portion having a hollow flow passage. The tube is formed so that when compressed in a prescribed compression direction the wall portion protrudes in a deformation direction perpendicular to the compression direction. The wall portion has non-uniform thickness along perimeter of the hollow flow passage. The wall portion has a first thickness measured in the deformation direction through the center of the hollow flow passage, and a second thickness at a location that comes into contact with the compressing mechanism, where the second thickness is greater than the first thickness.

According to this design, since the tube receives compressing force via the portion of the wall having the greater second thickness, the portion of the wall having the smaller first thickness will readily deform thereby, so that the hollow flow passage is compressed to a sufficient extent. Consequently, an adequate level of fluid pumping force can be created without an excessively high level of compressing force.

According to another aspect of the present invention, the wall portion includes mutually contacting wall portions which surround the hollow portion and which are to be compressed so as to contact one another. The mutually contacting wall portions include: readily contacting portions that readily contact one another at a given level of compressing force; and contact resistant portions that contact one another only at a higher level of compressing force than the readily contacting portions. A thickness of the wall portion around the hollow portion varies so that a higher level of force acts on the contact resistant portions than on the readily contacting portions.

Normally, the tube of a tube pump is designed so that after the mutually contacting portions are urged into contact against one another in the hollow portion by being compressed together by the compressing mechanism, causing the hollow flow passage to be substantially completely collapsed and occluded, when the compressing mechanism is subsequently released and the tube recovers, a high level of negative pressure is created thereby. The above design is such that the tube pump can smoothly transport the fluid by this negative pressure. This transport of fluid is accomplished by the hollow portion of the tube being substantially completely collapsed and occluded by the compressing mechanism. However, as depicted in FIG. 9B, in the conventional tube pump it was necessary to compress the tube to a greater extent than the equivalent of the tube wall thickness in order to sufficiently occlude the hollow portion, and in such cases the tube would give rise to strong reaction force; thus, a correspondingly high level of compressing force was required of the tube pump motor, which created the problem of lower efficiency of the tube pump. With the tube described hereinabove, however, in the hollow portion, the thickness of the wall portion varies so that a higher level of force acts on the contact resistant portions (the portions that resist becoming occluded) than on the readily contacting portions. Thus, it is possible for the hollow portion to be occluded sufficiently, by the compressing mechanism compressing the tube portion to the equivalent of the wall thickness of the tube portion, as depicted in FIG. 9B. Consequently, a sufficient level of negative pressure can be created without requiring a high level of compressing force by the motor, as in the past.

According to still another aspect of the present invention, the wall portion includes: a compressing wall portion for applying a force to compress the hollow portion; and a deformation assisting wall portion for accelerating deformation of the hollow portion by the compressing force. The deformation assisting wall portion has lower hardness than the compressing wall portion.

According to this design, when compressing force acts on the wall portion, the deformation assisting wall portion will reliably undergo deformation, compressing the hollow portion and readily assuming an occluded state, thereby eliminating the need for an excessively high level of compressing force.

According to another aspect of the present invention, the wall portion includes mutually contacting wall portions which surround the hollow portion and which are to be compressed so as to contact one another. The mutually contacting wall portions include: readily contacting portions that readily contact one another at a given level of compressing force; and contact resistant portions that contact one another only at a higher level of compressing force than the readily contacting portions. A curvature of an outside of the wall portion is smaller than a curvature of the hollow portion. The wall portion further includes compressing wall portions for applying compressing force to the contact resistant portions, the compressing wall portions having corner portions.

According to this design, since the curvature of the outside of the wall portion is smaller than the curvature of the hollow portion, the outside of the wall portion will deform, become smaller in curvature, and assume a flatter state due to the compressing force (which is the contact force of the compressing mechanism); and with further compression, the corner portions directly receive the compressing force of the compressing mechanism. Consequently, since the compressing force acts on the contact resistant portions via the corner portions, the contact resistant portions reliably come into mutual contact, and a sufficiently compressed (occluded) state of the hollow portion can be produced without an excessively high level of compressing force.

The present invention can be reduced to practice in various forms, for example, a tube pump, a tube for use in a tube pump, a liquid ejecting device employing a tube or tube pump, and the like.

DESCRIPTION OF THE PREFERRED EMBODIMENT

The preferred embodiments of the invention will be described in detail below making reference to the accompanying drawings. While the embodiments described hereinbelow represent specific preferred examples of the invention, various technologically preferred limitations are applied; however, the scope of the invention is not limited to the particular disclosure thereof in the following description, and is not limited to these particular embodiments.

Figure 1:
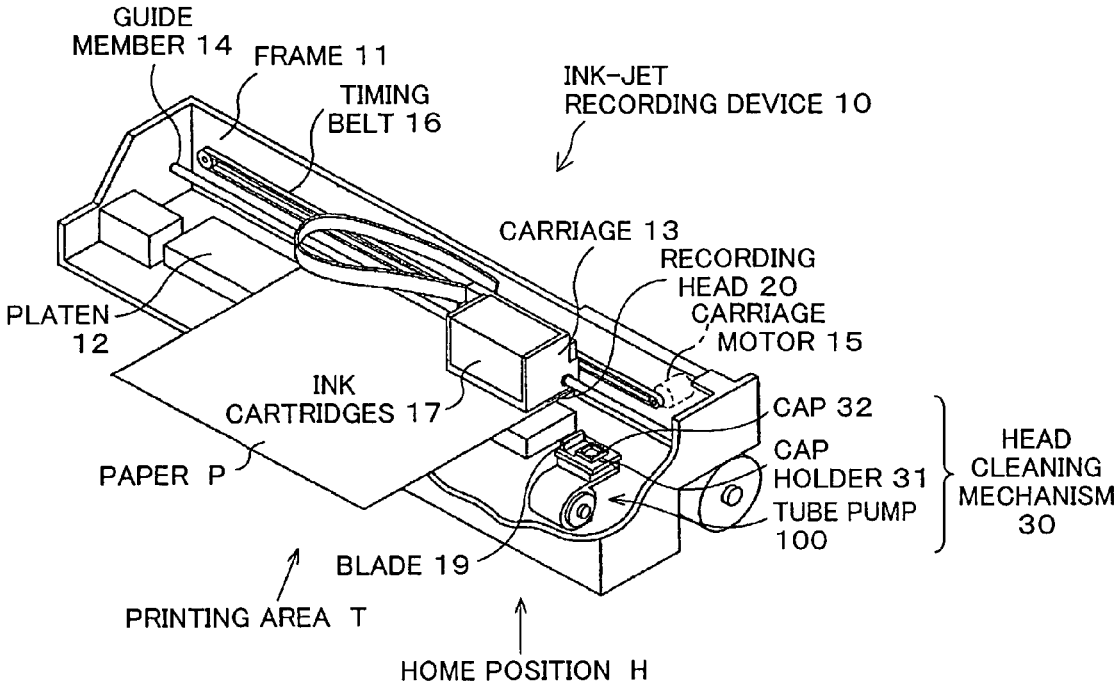
FIG. 1 is a schematic perspective view depicting an ink-jet recording device pertaining to an embodiment of a liquid ejecting device furnished with a tube pump according to the present invention.

FIG. 1 is a schematic perspective view depicting an ink-jet recording device (hereinafter "recording device") pertaining to an embodiment of a liquid ejecting device furnished with a tube pump according to the present invention. As shown in FIG. 1, the recording device 10 has a frame 11, with a platen 12 positioned on the frame 11. Above this platen 12 there is an arrangement for feeding paper P by means of a paper feed mechanism, not shown. The recording device 10 also has a carriage 13. The carriage 13 is supported moveably in the lengthwise direction of the platen 12 via a guide member 14, and is reciprocated by means of carriage motor 15 via a timing belt 16.

An ink-jet recording head (hereinafter "recording head") 20 is installed on the carriage 13 on the lower portion thereof. The recording head 20 is designed to eject a liquid, such as ink for example, onto the paper P. Specifically, the recording head 20 has nozzles for ejecting ink, and is designed to eject drops of ink from the nozzles by means of expansion and contraction of piezoelectric oscillators or the like. An ink cartridge 17 containing ink is detachably installed on the carriage 13, and is designed to supply ink from the ink cartridge 17 to the recording head 20. Specifically, by means of expansion and contraction of the piezoelectric oscillators as the carriage 13 moves along the platen 12, ink is ejected onto the paper P by the recording head 20 to carry out printing.

The frame 11 of FIG. 1 has a printing area T for positioning the paper P and carrying out printing on the paper P. The frame 11 at a first edge thereof has a home position H which is a nonprinting area. The carriage 13 is designed to be moveable between the printing area T and the home position H, by moving along the platen 12.

As shown in FIG. 1, a head cleaning mechanism 30 is situated at the home position H. The head cleaning mechanism 30 has a cap holder 31 and a tube pump 100. The cap holder is positioned on the frame 11 so as to be moveable up and down by raising/lowering means known in the art, not shown.

The head cleaning mechanism 30 has a cap 32. The cap 32 is designed so that the upper edge thereof is able to come into contact against the nozzle plate of the recording head 20 and seal off the nozzles of the recording head 20. As shown in FIG. 1, the recording device 10 is furnished with a blade 19. This blade 19 is designed to come into contact against the nozzle plate of the recording head 20 and perform a wiping operation by wiping away ink.

Figure 2:
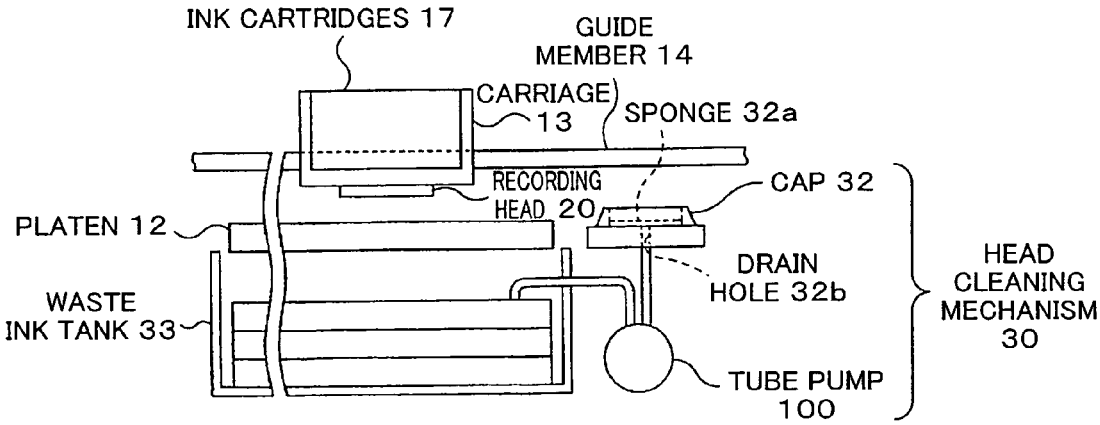
FIG. 2 is a schematic diagram depicting the head cleaning mechanism of FIG. 1.

FIG. 2 is a schematic diagram depicting the head cleaning mechanism 30 of FIG. 1. As shown in FIG. 2, the cap 32 has a sponge 32*a* of sheet form, disposed on the basal portion of the cap 32. This sponge 32*a* is designed so that, with the cap 32 in contact with the recording head 20, the sponge faces the nozzles of the recording head 20 across a prescribed gap and absorbs ink ejected from the nozzles of the recording head 20.

The cap 32 also has a drain hole 32*b* bored through the basal face thereof. With the cap sealing off the nozzles of the recording head 20, the tube pump 100 reduces pressure within the cap 32 to create negative pressure, suctioning out the ink from the nozzles of the recording head 20; the ink then drains into a waste ink tank 33 disposed inside the frame 11.

Figure 3:
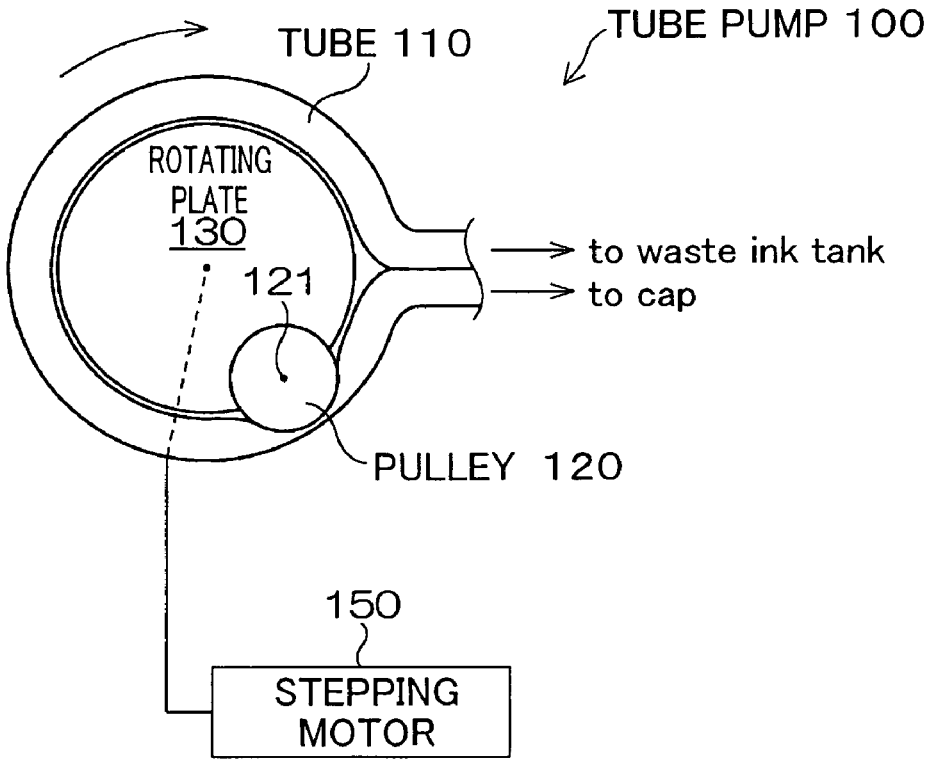
FIG. 3 is a schematic diagram depicting the structure of the tube pump.

FIG. 3 is a schematic diagram depicting the structure of the tube pump 100. The tube pump 100 has a tube 110 constituting the tube portion for suctioning out the ink. The tube 110 is composed of flexible tubing bowed into an annular configuration, with the two ends thereof drawn in the same direction and bound together in a coplanar arrangement.

The tube pump 100 has a compressing mechanism (e.g. a circular rod shaped pulley 120) positioned moveably along the inside periphery of the tube 110. The pulley 120 is designed to be rotatable about a pulley axis 121. The tube pump 100 also has a rotating mechanism (e.g. a disk shaped rotating plate 130) for moving the pulley 120 along the inside periphery of the tube 110. As shown in FIG. 3, a motor (e.g. a stepping motor 150) for generating a torque for the purpose of moving the pulley 120 along the inside periphery of the tube 110 is connected to the rotating plate 130. Specifically, when the stepping motor 150 operates to turn the rotating plate 130, the turning of the rotating plate 130 moves the pulley 120 along the inside peripheral of the tube 110 while compressing the tube 110. While a casing for housing the tube is present to the outside periphery of the tube 110, it has been omitted from the drawing. During operation of the tube pump, the tube 100 is compressed between the pulley 120 and the casing.

The compressing mechanism (pulley 120) and the rotating mechanism (rotating plate 130) need not be constituted as separate parts, but instead constituted as a single part. For example, the rotating mechanism may be designed with projecting portions disposed at one or more locations along the periphery of the rotating mechanism, these projecting portions functioning as the compressing mechanism. In another embodiment, the direction of compression of the tube 110 may be perpendicular to the plane of the paper in FIG. 3. Instead of the tube 110 being arranged in an annular configuration, it may be arranged in some other configuration such as an arcuate or linear configuration.

Figure 4A:
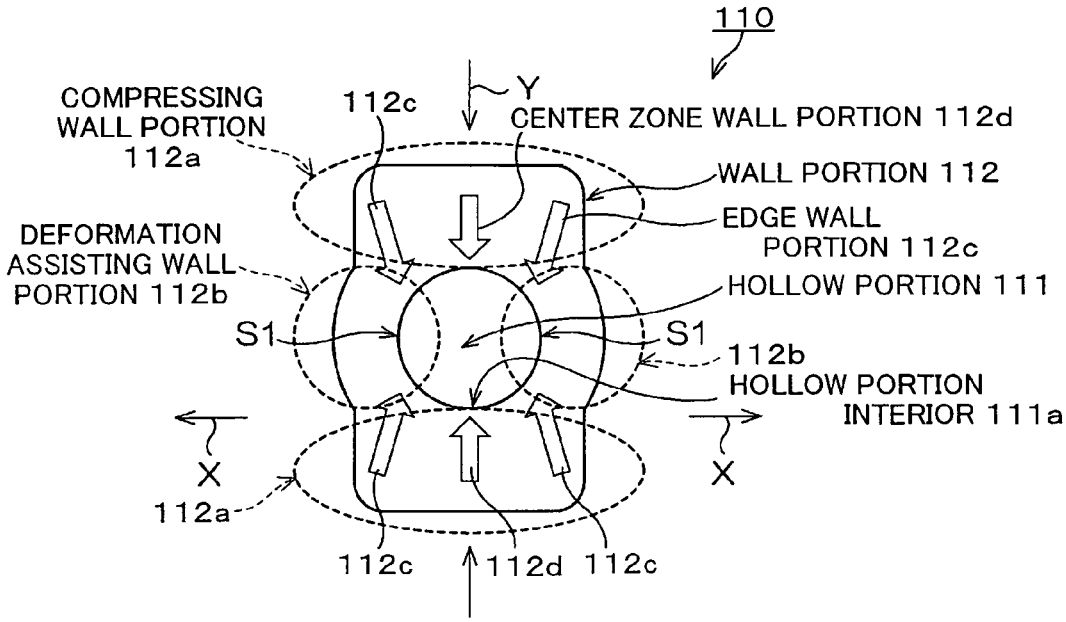
FIGS. 4A and 4B are schematic illustrations of the cross sectional arrangement of the tube of FIG. 3.
Figure 5A:
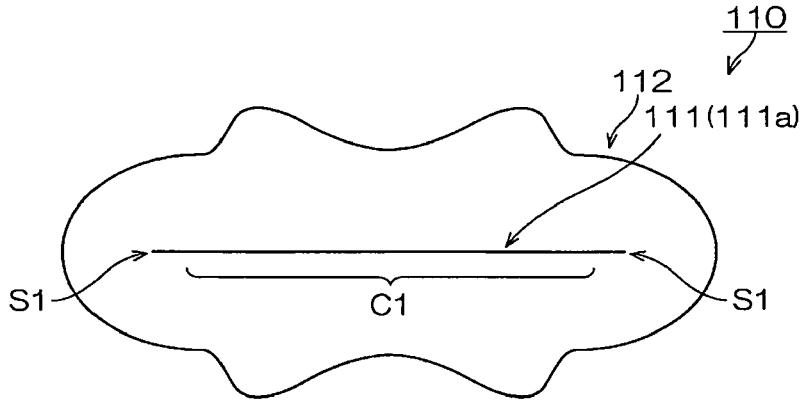
FIGS. 5A and 5B are schematic sectional views depicting the tube compressed in the direction of the arrows Y in FIG. 4A, by means of the pulley.
Figure 5B:
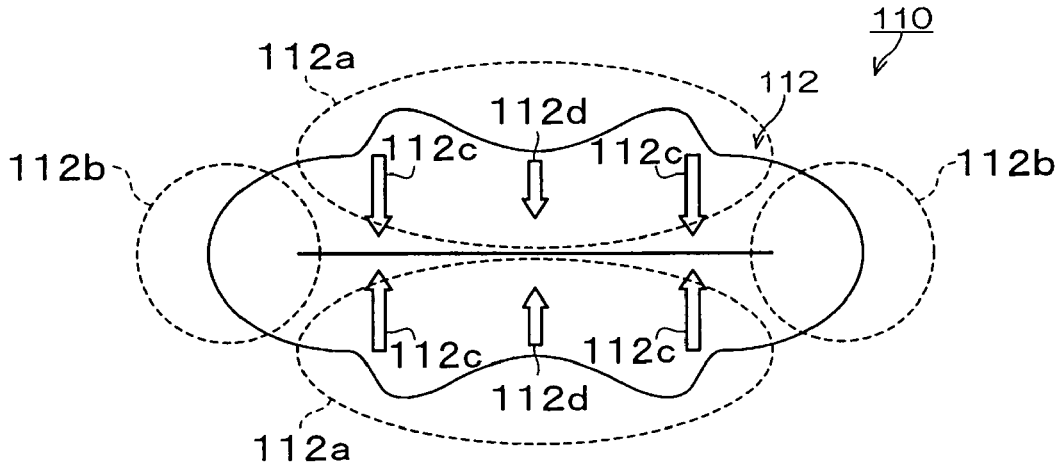

FIG. 4A is a schematic illustration of the cross sectional arrangement of the tube 110 of FIG. 3. The tube 110 has a hollow portion 111 in the center therefor for transporting ink. Around the hollow portion 111 is formed a wall portion 112 made of an elastomer, e.g. silicone rubber. The wall portion 112 may be virtually divided into compressing wall portions 112*a* for receiving compressing force from the outside, and deformation assisting wall portions 112*b* that undergo maximum deformation. The compressing wall portions 112*a* may be further divided into edge wall portions 112*c* and center zone wall portions 112*d*. The hollow portion 111 has an inside face, which will be called a hollow portion interior 111*a*. FIG. 5A is a schematic sectional view depicting the tube 110 compressed in the direction of the arrows Y in FIG. 4A, by means of the pulley 120. FIG. 5B shows the locations of the portions 112*a*-112*d* in this state. As shown in FIG. 5A, by means of compression of the tube 110, all areas of the hollow portion interior 111*a* come into mutual contact so that the hollow portion 111 is occluded. That is, the hollow portion interior 111*a* is one example of mutually contacting portions that undergo compression so that the wall portion 112 comes into mutual contact in the hollow portion 111 by means of compression by the pulley 120. FIGS. 5A and 5B depict an example wherein the compression faces that compress the tube 110 (i.e. the outside face of the pulley 120 and the inside face of the casing (omitted from FIG. 3) lying to the outside of the tube 110) are flat. However, these compression faces may be constituted as curving faces instead.

In this way, after the tube 110 has been compressed by the pulley 120, the pulley 120 undergoes displacement by means of the rotating plate 130 and moves away from the compressed portion of the tube 110, whereupon by means of the recovery force of the silicone rubber of the tube 110, the hollow portion interior 111*a* returns again to the state shown in FIG. 4A; a high level of negative pressure is created accordingly, and the tube 110 suctions the ink. That is, the design is such that the ink is suctioned by means of recovery of the hollow portion interior 111*a*.

Figure 9A:
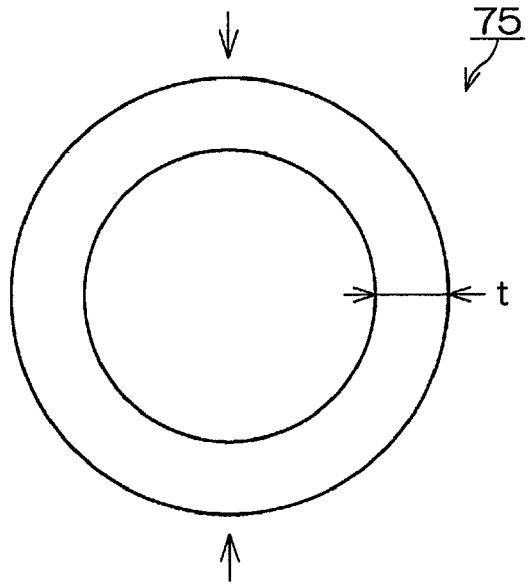
Fig.9A PRIOR ART
FIG. 9A is a schematic illustration of a conventional tube prior to being compressed.
Figure 9B:
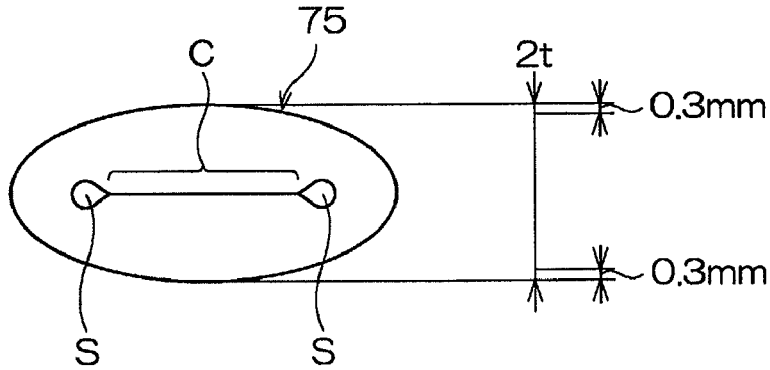
Fig.9B PRIOR ART
FIG. 9B is a schematic illustration of the conventional tube in the compressed state.

As shown in FIG. 5A, the hollow portion interior 111*a* may be virtually divided into a center zone C1 that corresponds to the center portion C of FIG. 9B (portion that comes into mutual contact at a prescribed level of compressing force), and marginal portions S1 that correspond to the gaps S of FIG. 9B (portions that come into mutual contact only at a level of compressing force greater than the prescribed level of compressing force). In the case shown in FIG. 9B, the center portion C comes into mutual contact by compression of the tube 75 to thickness equivalent to the wall thickness 2t, and the gaps S come into contact only with further compression of the tube 110. In FIG. 5A on the other hand, the center area C1 is an example of the readily contacting portions that come into mutual contact by a certain level of compressing force, while the marginal portions S1 are an example of the contact resistant portions that come into mutual contact only at a higher level of compressing force than in the center area C1. In the embodiment, the thickness of the wall portion 112 varies so that greater force acts on the marginal portions S1 than on the center area C1. This will be described more specifically later.

As shown in FIG. 4A, the wall portion 112 has compressing wall portions 112*a* for application of compressing force to the hollow portion 111 from the directions of the arrows Y. Specifically, two compressing wall portion 112*a*, 112*a* are positioned in the vertical direction to either side of the hollow portion 111 of FIG. 4A. These compressing wall portions 112*a* perform the function of transmitting compressing force from the pulley 120 to the hollow portion 111. On the wall portion 112 at each of the side faces of the hollow portion 111 of FIG. 4A are respectively formed deformation assisting wall portions 112*b* for accelerating deformation of the hollow portion 111 by means of compressing force. As shown in FIG. 4A, the thickness in the deformation assisting wall portions 112*b* is less than the thickness in the compressing wall portions 112*a*. Thus, when compressing force is applied from the pulley 120 in the directions of the arrows Y, the deformation assisting wall portions 112*b* undergo deformation in the directions of the arrows X in FIG. 4A, and readily deform to a state like that shown in FIG. 5A.

As shown in FIG. 4A, the deformation assisting wall portions 112*b* are deformed so as to protrude outwardly in the direction of the arrows X, i.e. the deformation direction, and therefore the design of the deformation assisting wall portions 112*b* permits easier deformation to the state shown in FIG. 5A.

Moreover, in preferred practice the silicone rubber in the deformation assisting wall portions 112*b* will have lower hardness than does the silicone rubber in the compressing wall portions 112*a*. In this way, in order to facilitate deformation to a state like that shown in FIG. 5A, the deformation assisting wall portions 112*b* are made thinner, protrude outwardly, and preferably have lower hardness as well. Thus, the tube 110 can be compressed without high rotary torque by the stepping motor 150, so lower torque on the part of the stepping motor 150 will suffice, and a tube pump 110 with high efficiency can be obtained.

As indicated by outlined arrows in FIG. 4A, the wall portion 112 has edge wall portions 112*c* constituting the portions to apply compressing force to the marginal portions S1, and center zone wall portions 112*d* constituting the portions subjected to compressing force applied to the center zone C1. The thickness in the edge wall portions 112*c* (length of the outlined arrows in FIG. 4A) is designed to be greater than the thickness in the center zone wall portions 112*d* (length of the outlined arrows in FIG. 4A). Consequently, when the tube 110 is compressed from the direction of the arrows Y, the compressing force acts more strongly on the marginal portions S1 than on the center zone C1.

In this way, in the present embodiment, since strong force acts on the marginal portions S1 which resist crushing, such as the gaps S in FIG. 9B discussed earlier, the hollow portion 111 undergoes substantially complete collapse without the occurrence of any gaps, and the tube 110 easily assumes the occluded state. In particular, due to the strong compressing force acting on the marginal portions S1, the tube 110 can be brought into the occluded state without a high level of rotary torque by the stepping motor 150, thereby affording a more efficient tube pump 100.

Figures 6A, 6B, 6C, 6D, 6E:
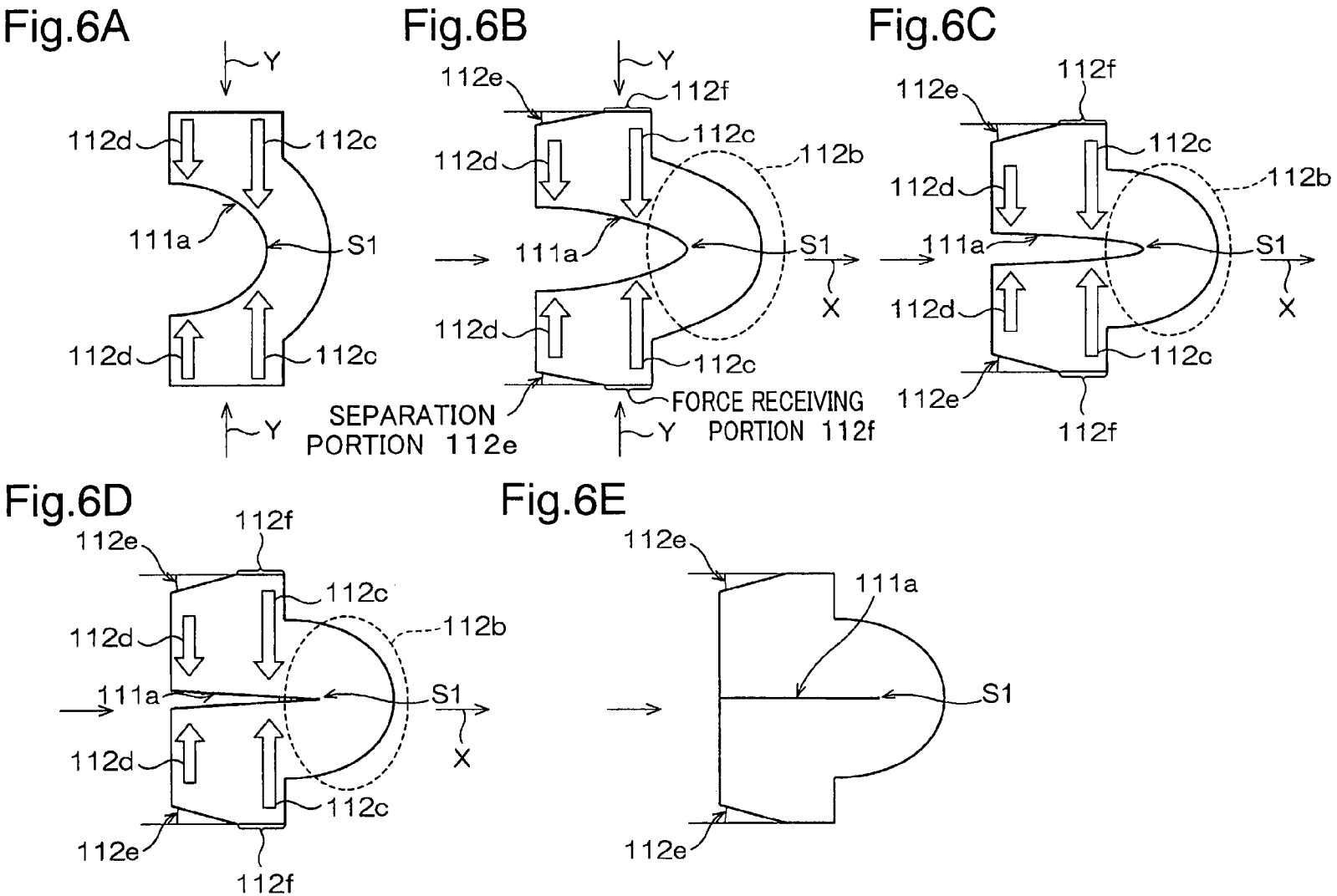
FIGS. 6A through 6E schematically illustrate the process whereby the tube depicted in FIG. 4A is compressed and becomes occluded as depicted in FIG. 5A.

FIGS. 6A-6E are schematic illustrations showing the process whereby the tube 110 depicted in FIG. 4A is compressed and becomes occluded as depicted in FIG. 5A. In FIG. 6A-6E, only the right half of the tube 100 of FIG. 4A is depicted. The left half behaves in the same way and is therefore omitted from the drawing. First, as shown in FIG. 6A, when compressing force acts in the direction indicated by the arrows Y, the deformation assisting wall portion 112*b* undergoes displacement outwardly towards the direction of arrow X as shown in FIG. 6B. This produces a gap, namely the separation portion 112*e* depicted in FIG. 6B, in the center portion of the outer face of the wall portion 112. At the same time, force receiving portions 112*f* form at the edge of the upper and lower faces, in those portions thereof excluding the separation portions 112*e*. Since the force receiving portions 112*f* transmit the compressing force of the pulley 120 directly to the tube 110, they apply strong force (compressing force) to the edge portion S1 of the hollow portion interior 111*a* positioned corresponding to the force receiving portions 112*f*. That is, the force receiving portions 112*f* are an example of the compressing force receiving portions positioned so as to protrude in the direction of the pulley 120 when the wall portion 112 is deformed through contact with the pulley 120.

As the pulley 120 compresses the tube 110 further from the state of FIG. 6B, the deformation assisting wall portion 112*b* deforms further outwardly, i.e. the direction of arrow X, as shown in FIG. 6C and FIG. 6D; and the edge portion S1 is subjected to strong compressing force from the force receiving portions 112*f*. The hollow portion interior 111*a* then comes into contact and becomes flat on itself starting from the edge portion S1. Subsequently the portion interior 111*a* becomes substantially completely compressed and flat on itself as shown in FIG. 6E, occluding the hollow portion 111 to produce the condition of FIG. 5A.

Thus, in the present embodiment, the edge portion S1—which tends to resist occlusion and is likely to produce a gap S as shown in FIG. 9B—can now be occluded efficiently. That is, the arrangement makes it possible for occlusion to be brought about without requiring a high level of torque by the stepping motor 150 as in the conventional tube pump. Consequently, a sufficient level of negative pressure can be created without increasing the level of torque by the stepping motor 150 as in the conventional tube pump.

In the tube 110 of the present embodiment, the outside of the wall portion 112 has a generally square shape as shown in FIG. 4A rather than a circular shape, making it easy for the operator to ascertain the installation direction when positioning the tube 110 in the tube pump 100. Thus, unlike the tube 75 depicted in FIG. 9A, there is no need for markings to identify a correct installation direction. Moreover, since the outside of the tube 110 is not arcuate, the design is resistant to slipping out of position due to vibration of the tube pump 100 after installation. Furthermore, since the thickness of the wall portion 112 of the tube 110 is at least partially greater than in the conventional tube pump, even-if the hollow portion 111 of the tube 110 is small in diameter, it will be protected by the wall portion 112 and resist buckling.

Figure 4B:
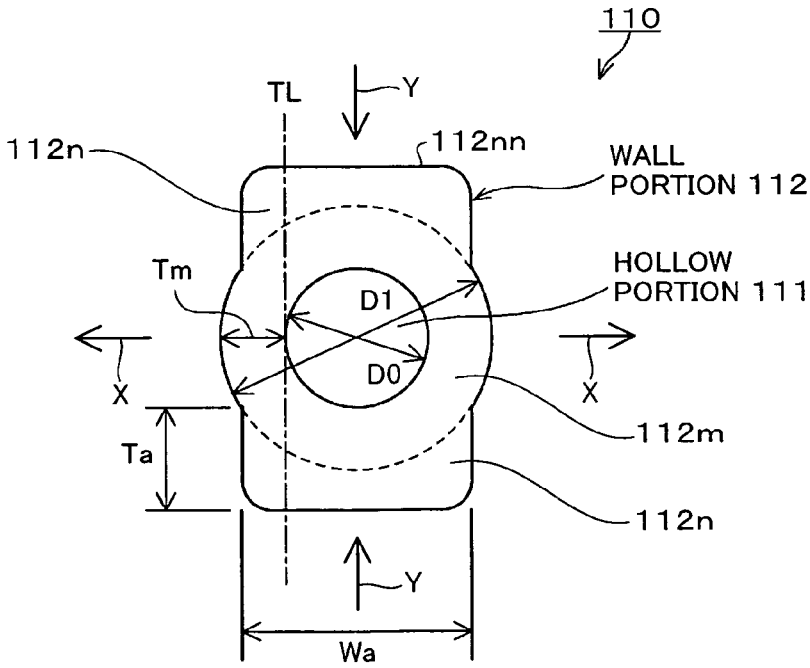

FIG. 4B is a drawing of the wall portion 112 which is divided in a different manner from FIG. 4A. Here, the wall portion 112 is virtually divided into a flow passage enclosing portion 112*m* surrounding the hollow portion 111, and supplemental thickness portions 112*n* disposed outwardly from the flow passage enclosing portion 112*m* in the compression direction Y. The flow passage enclosing portion 112*m* has a uniform wall thickness Tm. That is, the flow passage enclosing portion 112*m* has an annular shape defined by its inside diameter D0 and outside diameter D1. In preferred practice, the inside diameter D0 of the flow passage enclosing portion 112*m* is equal to the diameter of the hollow portion 111. The supplemental thickness portion 112*n* has width Wa in the direction X (i.e. the deformation direction) perpendicular to the compressing force direction Y. This width Wa may be smaller than the inside diameter D0 of the flow passage enclosing portion 112*m* (i.e. the diameter of the hollow portion 111), or greater than the outside diameter D1 of the flow passage enclosing portion 112*m*. However, typically it suffices for the width Wa of the supplemental thickness portion 112*n* to be set to a value equal to or less than the outside diameter D1 of the flow passage enclosing portion 112*m*. During compression of the tube 110, the outer face 112*nn* of the supplemental thickness portion 112*n* is the principal receiver of the compressing force. The wall thickness Ta of the wall portion 112 at this outer face 112*nn* is greater than the minimum wall thickness Tm (i.e. the wall thickness of the flow passage enclosing portion 112*m*). The wall portion where the supplemental thickness portion 112*n* is absent and constituted by the flow passage enclosing portion 112*m* only is the principal portion that undergoes deformation in the deformation direction X. That is, in this tube 110, since the compressing force is received in the section of greater wall thickness that includes the supplemental thickness portion 112*n*, compression can occur easily in the section of smaller wall thickness constituted by the flow passage enclosing portion 112*m* only.

In the tube 110 of FIG. 4B, there is drawn a tangent line TL which is tangent to the hollow portion 110 and parallel to the compression direction Y. The supplemental thickness portion 112*n* may be disposed at least at a location through which this tangent line TL passes. The reason for this, as will be understood from FIG. 5B and FIG. 6A-6E discussed earlier, is that the area in proximity to this tangent line TL has the function of efficiently compressing the hollow portion 111. However, where the diameter D0 of the hollow portion 111 is greater than the width Wa of the supplemental thickness portion 112*n*, the supplemental thickness portion 112*n* will not be present at the location through which the tangent line TL passes. However, with this design as well, less compressing force is required as compared to the prior art, and sufficient effect will be attained.

The supplemental thickness portion 112*n* may be made of a material of relatively high hardness, while the flow passage enclosing portion 112*m* may be made of a material of relatively low hardness. It is possible thereby to produce fluid pumping force with a lower level of compressing force. In this case, it is not necessary for the entire flow passage enclosing portion 112*m* to be formed of material of relatively low hardness, it being sufficient for those portions corresponding to the two edges lying in the deformation direction X to be constituted by material of relatively low hardness. It will be understood that in this design as well, average hardness of the flow passage enclosing portion 112*m* is lower than average hardness of the supplemental thickness portion 112*n*.

In the embodiment illustrated in FIGS. 4A and 4B, the hollow portion 111 is drawn as a true circle; in actual practice, however, it is difficult to achieve a true circle due to limitations imposed by the manufacturing process, and in most cases the shape will be a somewhat deformed circular shape. Herein, the term "circular shape" is used in a broad sense to include ellipses and other somewhat deformed circular shapes. In preferred practice, however, the circular shape of the hollow portion 111 in the absence of applied compressing force will be such that the ratio of the minor axis to the major axis is 0.8 or greater, more preferably 0.9 or greater. As this ratio approaches 1, recovery force is higher, and greater liquid pumping force can be achieved.

FIGS. 7A through 7E are schematic diagrams showing modified examples of the present embodiment. Since the designs are substantially the same as the tube 110 of the tube pump 100 according to the embodiment discussed above, components common to them are assigned the same symbols and are not described in detail; the following description focuses instead on the differences.

Figure 7A:
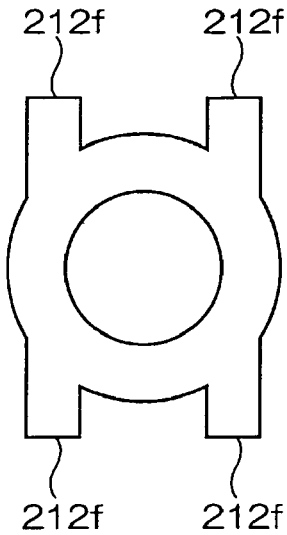
FIGS. 7A through 7E are schematic diagrams showing modified examples of the present embodiment.

FIG. 7A features force receiving portions 212*f* corresponding to the force receiving portions 112*f* of the embodiment discussed above. The force receiving portions 212*f* is formed to protrude outward in the non deformed state. In the design of FIG. 7A as well, it is possible to recognize portions similar to the flow passage enclosing portion 112*n* and supplemental thickness portion 112*m* described in FIG. 4B. That is, the force receiving portions 212*f* are equivalent to the supplemental thickness portion 112*m*. Also, in the design of FIG. 7A, two force receiving portions 212*f* project out at each of locations offset a given distance to the left and right from the center in the deformation direction, on the upper and lower sides of the tube respectively, with the wall portion having constant wall thickness except in these areas. With this design, since the force receiving portions 212*f* constituting the supplemental thickness portion can be small, a resultant advantage is lighter weight. However, tube formation is easier with the design of the FIG. 4A.

Figure 7B:
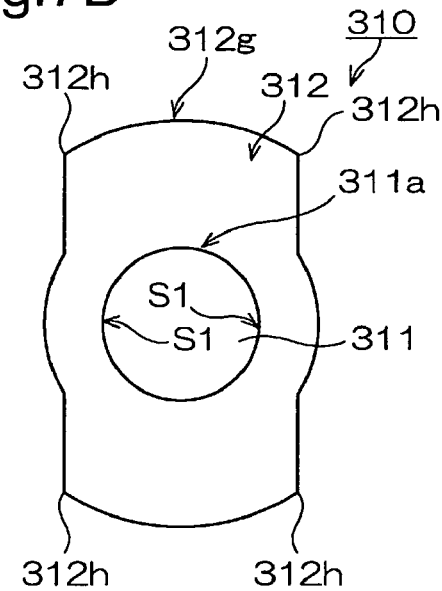
Figure 7C:
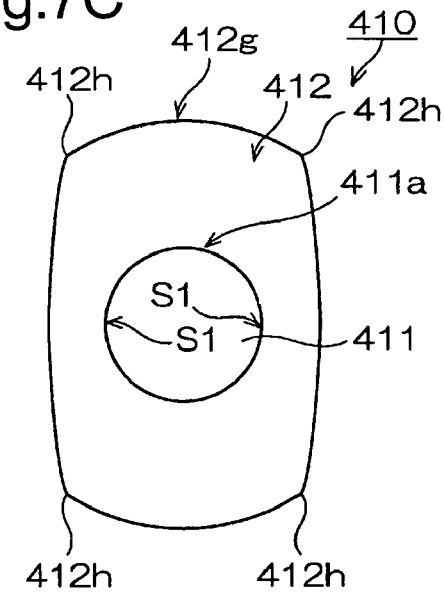

FIG. 7B and FIG. 7C feature a wall portion 312, 412 having an outside face 312*g*, 412*g* whose curvature is smaller than the curvature of the hollow portion 311, 411. Thus, the designs feature wall thickness between the hollow portion 311, 411 and the outside face 312*g*, 412*g* of the wall portion 312, 412, that varies by location. For example, as shown in FIGS. 7B and 7C, wall thickness is greater at the two edges in the drawings of the hollow portions 311, 411 than in the center portion. Corner portions 312*h*, 412*h* constituting areas for application of compressing force to the marginal portions S1 are formed in the upper and lower portions of the wall portions 312, 412. Thus, when the tube 310, 410 is compressed by the compressing force of the pulley 120 causing the outside face 312*g*, 412*g* to deform, their upper and lower portions flattens out; subsequently, the corner portions 312*h*, 412*h*, which now function like the force receiving portions 212*f* of FIG. 7A, act to compress the marginal portions S1 of the hollow portion 311, 411. Consequently, as in the embodiment discussed previously, the hollow portion 311, 411 can be placed in a substantially completely occluded state, and sufficient negative pressure produced, without a high level of rotary torque by the stepping motor 150. In the designs of FIGS. 7B and 7C as well, it is possible to recognize portions similar respectively to the flow passage enclosing portion 112*n* and supplemental thickness portion 112*m* described in FIG. 4B. In other examples, the curvature of the outside faces 312*g*, 412*g* of the wall portions 312, 412 may be the same as the curvature of the hollow portion 311, 411. This design can be viewed as one employing unchanging thickness for the supplemental thickness portion 112*m* described in FIG. 4B. Alternatively, it is also possible for curvature of the outside faces 312*g*, 412*g* of the wall portions 312, 412 may to be greater than the curvature of the hollow portion 311, 411.

Figure 7D:
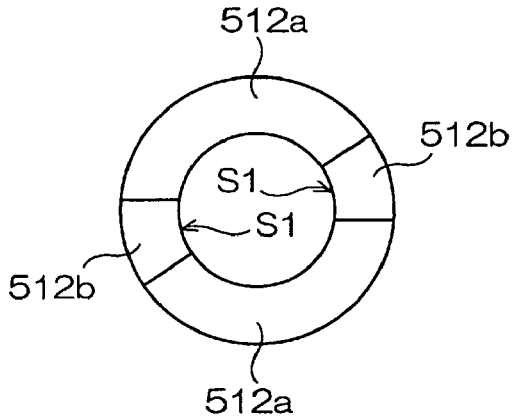
Figure 7E:
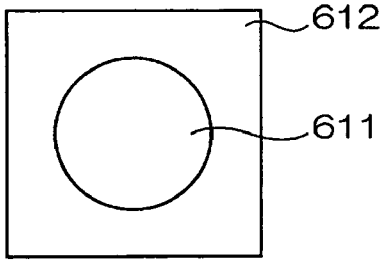

The tube of FIG. 7D is similar in overall shape to the conventional tube 75, but the deformation assisting wall portions 512*b* are formed with lower hardness than the compressing wall portions 512*a*. In this case as well, since the low-hardness deformation assisting wall portions 512*b* deform readily, the marginal portions S1 can be compressed with low torque of the stepping motor 150. FIG. 7E shows another tube where wall portion 612 are formed surrounding the hollow portion 611. In the design of FIG. 7E as well, it is possible to recognize portions similar respectively to the flow passage enclosing portion 112*n* and supplemental thickness portion 112*m* described in FIG. 4B. However, it will be apparent that in FIG. 7E supplemental thickness portions are disposed only at the four corners of the tube.

Figure 8A:
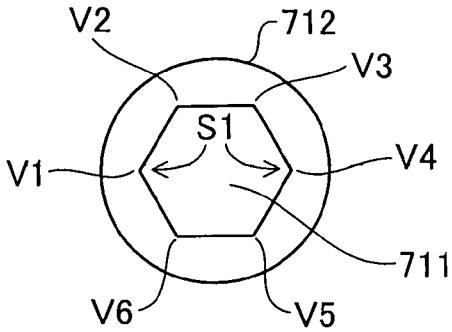
FIGS. 8A and 8B are sectional views of tubes in other modified examples of the invention.

FIG. 8A is a sectional view of a tube in yet another modified example of the invention. This tube has a hollow portion 711 of hexagonal shape, and a wall portion 712 surrounding this hollow portion 711. In this example, while the outside shape of the wall portion 712 is circular, a shape other than circular would be acceptable as well. The six vertices V1-V6 of the hollow portion 711 are each constituted by two flat wall faces forming an approximately 120° angle; no curving faces are produced. In this design as well, the marginal portions S1 of the inside wall of the hollow portion 711 are readily compressible. This wall portion 712 can be considered as having a design of gradually decreasing wall thickness at either edge in the deformation direction, such that wall thickness reaches a minimum at both edges along the deformation direction (left to right direction in the drawing). This design may obtained when a regular n-sided polygon (n is an even number of 4 or greater) is employed as the shape of the hollow portion 711. In preferred practice, n is 6 or above. It is also possible to employ a polygon which is not a regular polygon as the shape of the hollow portion 711.

Figure 8B:
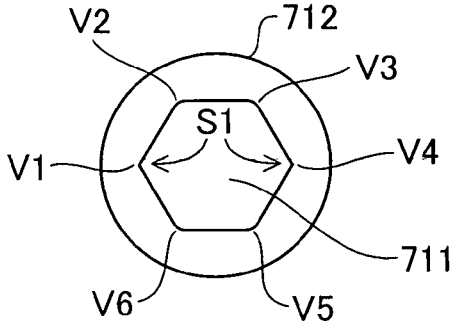

FIG. 8B depicts a design in which, of the six vertices V1-V6 of FIG. 8A, the two left and right vertices V1, V4 are kept as-is, while the other four vertices V2, V3, V5, V6 are given curving faces. That is, in this design, the vertices V2, V3, V5, V6 except for those at the edges in the deformation direction are designed to have a more moderate shape change than the vertices V1, V4 at the edges in the deformation direction. It will be apparent that in this design as well, the marginal portions S1 are readily compressed. From the standpoint of achieving a high level of recovery force, the design of FIG. 8A is preferable to that of FIG. 8B, however.

As will be apparent from the embodiment and modified examples set forth herein, the hollow portion or hollow flow passage is not limited to circular shape, it being possible to employ various non-circular shapes such as hexagonal or other regular polygon, or a regular polygon with rounded corners. From the standpoint of achieving a high level of recovery force, however, hollow portion shape which approximates circular is preferred.

The design of the tube is not limited to those taught in the preceding embodiment and modified examples, and there can be employed various designs of non-uniform wall thickness of the wall portion along the perimeter of the hollow portion or hollow flow passage. In this case, as in the example of FIG. 4B, it is preferable for the second wall thickness Ta at the location in contact with the compressing mechanism to be greater than the first wall thickness Tm measured along the deformation direction X through the center of the hollow portion 111. It will be apparent that the embodiment and modified examples except for FIG. 7D have this feature. The "wall thickness" of the wall portion can be a value measured along a direction extending radially from the center of the hollow portion, in a state with no compressing force acting on the tube.

The invention is not limited to the preceding embodiment and modified examples, and may be reduced to practice in various other forms without departing from the spirit thereof. For example, modified examples such as the following are possible.

Modified Example 1

The present invention is not limited to ink-jet recording devices, and is applicable analogously to recording heads for use in printers and other such image recording devices; to colorant ejection heads used in the production of color filters for liquid crystal displays and the like; to electrode material ejection heads used for forming electrodes of organic EL displays, FED (field emission displays) and the like; liquid ejection devices that employ liquid ejection heads for ejecting liquids, such as bioorganic substance ejection heads used in biochip manufacture; sample material ejection devices for precision pipettes, and the like.

Modified Example 2

The present invention is not limited to tube pumps for liquids, and is applicable as well to tube pumps for gases, and to tube pumps for fluids in general.

What is claimed is:

1. A tube for use in a tube pump for pumping a fluid through compression of the tube by a compressing mechanism in association with movement of the compressing mechanism along the tube, comprising:

a wall portion of elastic material, the wall portion having a hollow flow passage, wherein the tube is formed so that when compressed in a prescribed compression direction the wall portion protrudes in a deformation direction which is perpendicular to the compression direction and which is not an axial direction of the tube, the wall portion has non-uniform thickness along a perimeter of the hollow flow passage, the wall portion has a first thickness measured in the deformation direction through the center of the hollow flow passage, and a second thickness at a location that comes into contact with the compressing mechanism, the second thickness being greater than the first thickness, and the hollow flow passage has a circular-shaped cross section, and the wall portion includes:

a uniform-thickness flow passage enclosing portion enclosing the hollow flow passage and forming a portion having the first thickness; and a first and second supplemental thickness portion, the first supplemental thickness portion disposed around only one end of the uniform-thickness flow passage enclosing portion in the compression direction and the second supplemental thickness portion disposed around only another end that opposes the one end of the uniform-thickness flow passage enclosing portion in the compression direction, wherein an entirety of the tube is formed of a same material, wherein each of the first and second supplemental thickness portions have a flat end portion, and wherein each of the first and second supplemental thickness portions have a recessed shape when compressed.

2. A tube for use in a tube pump for pumping a fluid through compression of the tube by a compressing mechanism in association with movement of the compressing mechanism along the tube, comprising:

a wall portion of elastic material, the wall portion having a circular hollow portion having a circular cross section for transporting a fluid, wherein the wall portion includes mutually contacting wall portions which surround the circular hollow portion and which are to be compressed so as to contact one another, the mutually contacting wall portions include:

readily contacting portions that readily contact one another at a given level of compressing force; and contact resistant portions that contact one another only at a higher level of compressing force than the readily contacting portions, wherein a thickness of the wall portion around the circular hollow portion varies so that a higher level of force acts on the contact resistant portions than on the readily contacting portions, wherein, the wall portion further comprises a first and second supplemental thickness portion, the first supplemental thickness portion disposed around only one end of the mutually contacting wall portions in the compression direction and the second supplemental thickness portion disposed around only another end that opposes the one end of the mutually contacting wall portions in the compression direction, and wherein an entirety of the tube is formed of a same material, wherein each of the first and second supplemental thickness portions have a flat end portion, and wherein each of the first and second supplemental thickness portions have a recessed shape when compressed.

* * * * *